US008598521B2

(12) United States Patent
Levis et al.

(10) Patent No.: US 8,598,521 B2
(45) Date of Patent: Dec. 3, 2013

(54) VAPORIZATION DEVICE AND METHOD FOR IMAGING MASS SPECTROMETRY

(75) Inventors: Robert J. Levis, Rose Valley, PA (US); John J. Brady, Philadelphia, PA (US); Elizabeth J. Judge, Seaville, NJ (US)

(73) Assignee: Temple University of the Commonwealth System of Higher Education, Philadelphia, PA (US)

( * ) Notice: Subject to any disclaimer, the term of this patent is extended or adjusted under 35 U.S.C. 154(b) by 9 days.

(21) Appl. No.: 13/390,722

(22) PCT Filed: Aug. 17, 2010

(86) PCT No.: PCT/US2010/045711

§ 371 (c)(1),
(2), (4) Date: Feb. 16, 2012

(87) PCT Pub. No.: WO2011/022364

PCT Pub. Date: Feb. 24, 2011

(65) Prior Publication Data

US 2012/0149009 A1 Jun. 14, 2012

Related U.S. Application Data

(60) Provisional application No. 61/234,526, filed on Aug. 17, 2009, provisional application No. 61/262,676, filed on Nov. 19, 2009.

(51) Int. Cl.
*H01J 49/26* (2006.01)

(52) U.S. Cl.
USPC ..... 250/288; 250/281; 250/282

(58) Field of Classification Search
USPC ..... 250/281, 282, 288
See application file for complete search history.

(56) References Cited

U.S. PATENT DOCUMENTS

| | | | | |
|---|---|---|---|---|
| 6,207,954 | B1 | 3/2001 | Andrien et al. | |
| 6,346,352 | B1 | 2/2002 | Hayden et al. | |
| 6,825,045 | B2 | 11/2004 | Haglund et al. | |
| 7,138,626 | B1 | 11/2006 | Karpetsky | |
| 2009/0039283 | A1 * | 2/2009 | Franzen et al. | 250/425 |
| 2010/0123075 | A1 * | 5/2010 | Dantus et al. | 250/282 |
| 2010/0213367 | A1 * | 8/2010 | Miller | 250/282 |

FOREIGN PATENT DOCUMENTS

| | | |
|---|---|---|
| EP | 0 819 937 | 1/1998 |
| EP | 1 847 632 | 10/2007 |

OTHER PUBLICATIONS

International Search Report for PCT/US2010/045711 mailed Nov. 11, 2010.

Sampson et al., "Generation and Detection of Multiply-Charged Peptides and Proteins by Matrix-Assisted Laser Desorption Electrospray Ionization (MALDESI) Fourier Transform Ion Cyclotron Resonance Mass Spectrometry," Jour. of the American Society for Mass Spectrometry, Sep. 6, 2006, vol. 17, pp. 1712-1716, XP0025114382.

(Continued)

*Primary Examiner* — Nicole Ippolito
(74) *Attorney, Agent, or Firm* — RatnerPrestia

(57) ABSTRACT

Methods and apparatus for analyzing samples are disclosed. The samples are analyzed by vaporizing molecules from a sample in a sample area with a femtosecond laser beam under ambient conditions, ionizing the vaporized molecules with electrospray ionization under the ambient conditions to form ions; and analyzing and detecting the ions.

22 Claims, 12 Drawing Sheets

(56) References Cited

OTHER PUBLICATIONS

Shiea et al., "Electrospray-assisted laser desorption/ionization mass spectrometry for direct ambient anallysis of solids," Rapid Communications in Mass Spectrometry, Nov. 18, 2005, vol. 19, pp. 3701-3704, XP007915573.

Prybyla et al., "Desorption Induced by Femtosecond Laser Pulses," Physical Review Letters, Mar. 26, 1990, vol. 64, No. 13, pp. 1537-1540, XP007915579.

* cited by examiner

Intensity (a.u.)
m/z
[M+H]+
[M-tBu-H]+
[M+Na]+
[M+2Na]2+
6X
Intensity (a.u.)

Intensity (a.u.)
0.04
0.03
0.02
0.01
0.00
200
300
400
500
600
m/z
[M+H]+
[M-CH2CH2COOH-CH2COOH+H]+
[M-CHCH2-CH2CH2COOH-CH2COOH+H]+

Intensity (a.u.)
m/z
[M-CN+2H]2+
[M+2H]2+
[M+H+Na]2+
[M+2Na]2+
[M+H]+
[M-CN+H]+
[dimethylbenzimidazole+H]+
[sugar]+
[M-CN-base-sugar-PO4-Co]+
2X
20X

VAPORIZATION DEVICE AND METHOD FOR IMAGING MASS SPECTROMETRY

CROSS REFERENCE TO RELATED APPLICATIONS

This application is related to and claims the benefit of U.S. provisional application Ser. No. 61/234,526 filed on Aug. 17, 2009; U.S. provisional application Ser. No. 61/262,676 filed on Nov. 19, 2009; and PCT/US2010/045711 filed Aug. 17, 2010, the contents of each are incorporated fully herein by reference.

STATEMENT REGARDING FEDERALLY SPONSORED RESEARCH

This invention was made with government support under contract number CHE0518497 awarded by the National Science Foundation and contract number W911NF0810020 awarded by The Army Research Office. The government has rights in this invention.

BACKGROUND OF THE INVENTION

In the field of mass spectrometry, a sample is ionized, for example, with an electron beam or laser pulse and subjected to analysis to determine the mass-to-charge (m/z) ratio. If the electron beam or laser pulse has sufficient energy, the ion can fragment and the fragments can be analyzed to determine the structure of the original molecule. The analysis of nonvolatile molecules is typically enabled by dissolving the molecule in a great excess of another molecule followed by vaporization of the solvent using either electrospray or laser desorption methods. The gas phase molecule can then be ionized and analyzed.

SUMMARY OF THE INVENTION

The present invention is embodied in methods and apparatus for analyzing samples. An exemplary apparatus for analyzing samples includes a laser configured to vaporize molecules from a sample in a sample area with a femtosecond laser beam under ambient conditions, an electrospray ionization (ESI) device positioned proximate to the sample area, the ESI device configured to ionize the vaporized molecules under the ambient conditions to form ions, and an analyzer configured to analyze and detect the ions.

An exemplary method for analyzing samples includes vaporizing molecules from a sample in a sample area with a femtosecond laser beam under ambient conditions, ionizing the vaporized neutral molecules with electrospray ionization under the ambient conditions to form ions, and analyzing and detecting the ions. According to an exemplary embodiment, the ions may be analyzed and detected as a function of position on the sample area.

BRIEF DESCRIPTION OF THE DRAWINGS

The invention may be understood from the following detailed description when read in connection with the accompanying drawings. This emphasizes that according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
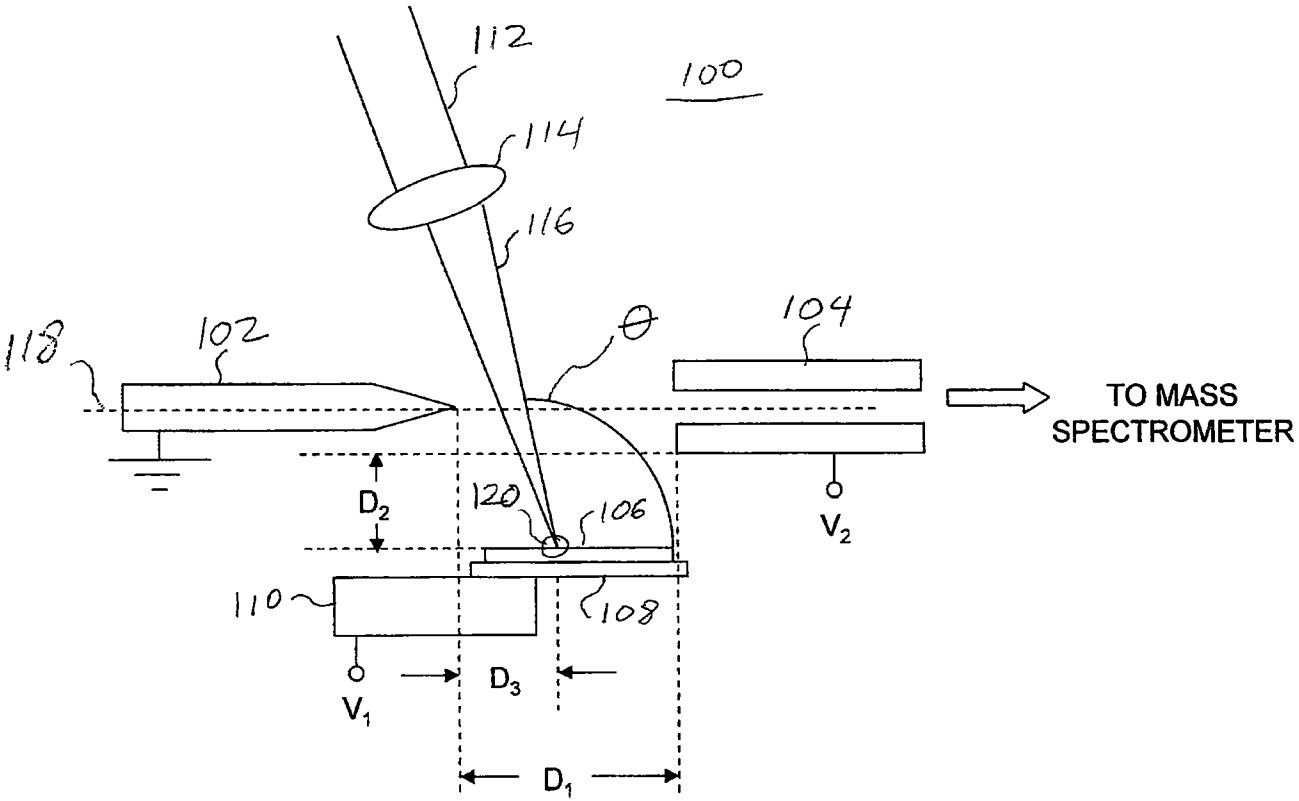
FIG. 1 is a cross-sectional diagram of an exemplary ion generator for generating ions from a sample in accordance with an exemplary aspect of the present invention.

Exemplary aspects of the present invention relate to methods and apparatus for analyzing samples. An exemplary apparatus includes a laser configured to vaporize molecules from a sample in a sample area (e.g., on a sample holder) with a femtosecond laser beam under ambient conditions. The exemplary apparatus also includes an electrospray ionization (ESI) device positioned proximate to the sample area. The ESI device may be configured to ionize the vaporized molecules under ambient conditions to form ions. The exemplary apparatus further includes an analyzer configured to analyze and detect the ions. Suitable lasers, ESI devices, and analyzers will be understood by one of skill in the art from the description herein.

In exemplary methods and apparatus of the present invention, the vaporization and ionization processes are performed separately under ambient conditions. Experiments by the inventors with biologically relevant macromolecules, proteins, peptides, lipids, carbohydrates, nucleic acids, chemical warfare agents, DNA, RNA, pathogens, serum, polymers, man made synthesized compounds, natural compounds, food samples, pharmaceuticals, narcotics, a biological fluid, blood, a biopsy sample, explosives, dyes, cells, a nanomaterial or a nanoparticle, viruses, animal tissue or plant tissue in the sample indicate that vaporization does occur under ambient conditions when vaporization is performed using a femtosecond laser. Accordingly, embodiments of the present invention may be used to analyze ions to provide an indication of at least one of biological macromolecules, proteins, peptides, lipids, carbohydrates, nucleic acids, chemical warfare agents, DNA, RNA, pathogens, serum, polymers, man made synthesized compounds, extracted natural compounds, food samples, pharmaceuticals, narcotics, explosives, dyes, cells, a nanomaterial or a nanoparticle, biological fluids, blood, biopsy samples, viruses, normal or diseased animal tissue, normal or diseased plant tissue, normal or diseased human tissue, or tissue typing in the sample investigated. According to one aspect of the present invention, an exemplary apparatus may be used as a molecular imaging microscope, to produce a spatially resolved m/z image of the analyzed sample, where m equals mass of the molecule plus any adducts and z equals the number of charges on the molecule.

One conventional technique used to ionize molecules relates to matrix-assisted laser desorption/ionization (MALDI). According to the MALDI technique, a laser beam is used to trigger desorption and ionization of molecules from a sample, where the sample is mixed with an organic acid or metal matrix, (referred to herein as a matrix-assisted sample). The laser beam is configured to be resonant with an electronic transition in the matrix assisted sample. The matrix absorbs the energy from the laser beam, protecting the sample molecules from being destroyed by the laser beam and transferring the sample molecules into the gas phase. Another conventional technique includes ESI, which uses a solvent containing sample molecules that is dispersed by an electrospray into an aerosol, to ionize the molecules. A further conventional technique includes electrospray laser desorption ionization (ELDI), which uses a nanosecond laser beam to trigger desorption of sample molecules and ionizes the desorbed molecules by an electrosprayed solvent. Further conventional techniques include variations on MALDI and ESI, such as matrix assisted laser desorption ESI (MALDESI) and laser ablation ESI (LAESI).

In general, conventional techniques, such as those based on ELDI and MALDESI, typically use lasers to resonantly excite molecules from a sample or molecules from a matrix-assisted sample to enable vaporization. The absorption cross section of a molecule, a matrix or a substrate may increase by about six orders of magnitude when there is a resonant transition in comparison to nonresonant excitation. This allows for more energy to be absorbed for resonant excitation, when laser power densities are on the order of about $10^6$ W $cm^{-2}$. The absorbed energy may be used to desorb molecules via a thermal, a phase explosion, an impulsive, or an electronic-induced (i.e., vaporization) desorption mechanism. In general, a vast majority of molecules may not be capable of resonant excitation with a laser in the optical region. For those molecules where resonant excitation is not feasible, a specific matrix is typically used. Methods to vaporize nonvolatile molecules without the application of a matrix are of considerable interest for gas phase analysis methods. The use of nonresonant laser excitation for the vaporization of molecules at atmospheric pressure may further reduce sample compatibility restrictions and allow a variety of molecules to be studied without the need for resonant excitation in the sample, matrix-assisted sample or substrate.

Figure 2:
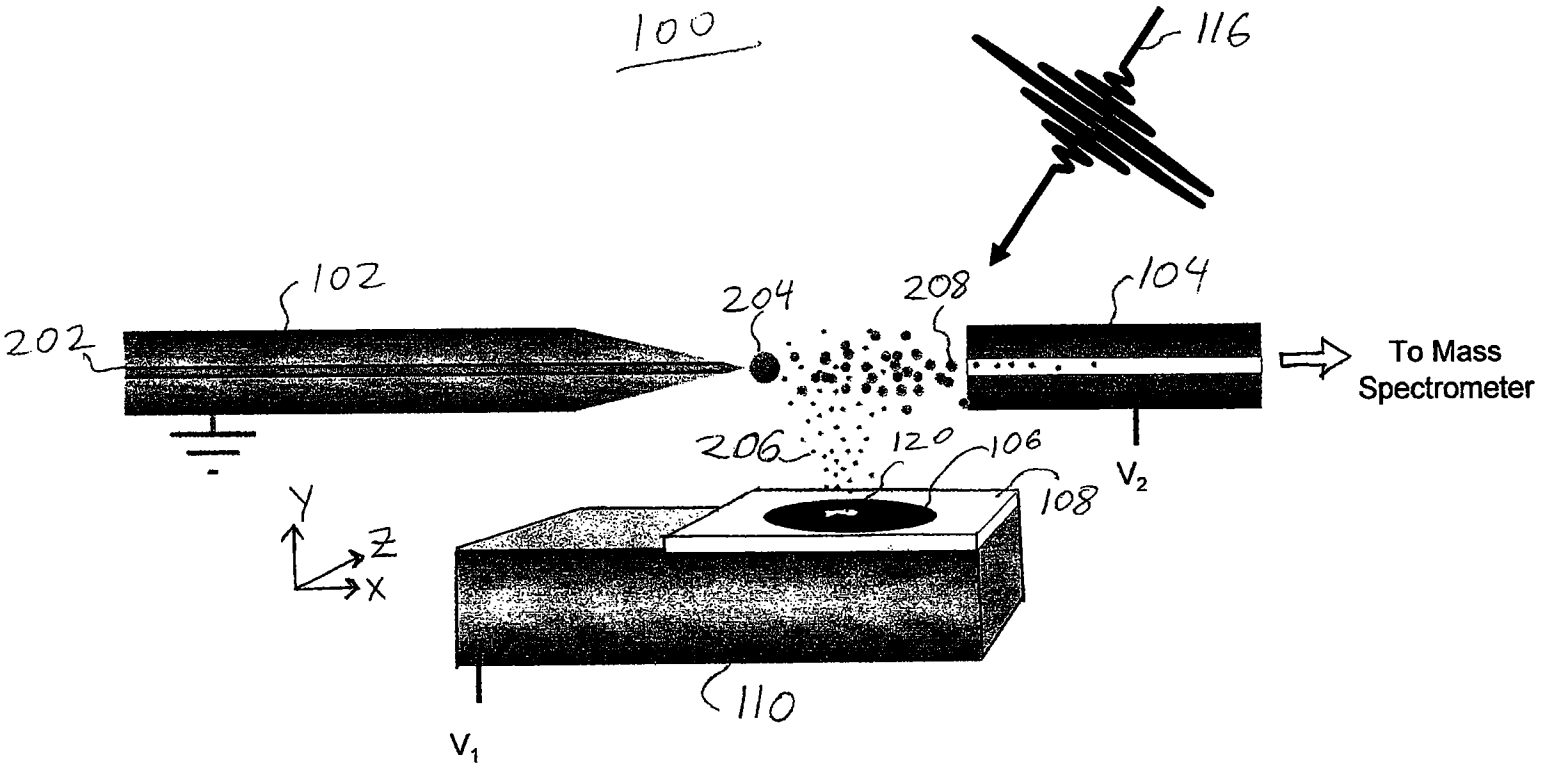
FIG. 2 is a perspective view diagram of the ion generator shown in FIG. 1, illustrating an example of generating ions from a sample in accordance with an exemplary aspect of the present invention.

Referring next to FIGS. 1 and 2, an exemplary ion generator, designated generally as 100, is shown. In particular, FIG. 1 is a cross-sectional diagram of ion generator 100; and FIG. 2 is a perspective view diagram of ion generator 100, illustrating generation of ions 208 from sample 106 using a focused femtosecond (fs) laser beam 116 and ESI needle 102.

Ion generator 100 includes ESI needle 102 of an ESI device (not shown), capillary 104, sample plate 108 holding sample 106 and sample plate holder 110. The tip of ESI needle 102 is separated from capillary 104 by distance $D_1$. Capillary 104 is positioned above sample 106 by distance $D_2$ Femtosecond laser beam 112 is focused by lens 114 to form focused beam 116. Focused beam 116 is directed to ablation spot 120 on sample 106 at incidence angle θ. Distance $D_3$ represents the distance between the tip of ESI needle 102 to ablation spot 120. In an exemplary embodiment, distance $D_1$ is between about 5 mm-15 mm, distance $D_2$ is between about 1 mm-20 mm, and distance $D_3$ is between about 0.1 mm-3 mm. Although according to an exemplary embodiment incidence angle θ is 45°, incidence angle θ may be between about 30° to 90°. Lens 114 may include any suitable optic for focusing fs laser beam 112 onto sample 106.

Capillary 104 is positioned such that a capillary axis 118 (also referred to herein as an ion propagation axis) extending through capillary 104 is parallel to a longitudinal axis of ESI needle 102. In other words, the longitudinal axis of ESI needle 301 may be positioned at 0° with respect to the capillary axis 118. Although ESI needle 102 is shown as being positioned along capillary axis 118, ESI needle 102 may be positioned parallel to and offset from capillary axis 118, such as below or above capillary axis 118. According to another embodiment, ESI needle 102 may be perpendicular to capillary axis 118. According to an exemplary embodiment, capillary 104 is a glass capillary. Capillary 104 may also be formed from essentially any dielectric or metal material.

Sample 106 may include solid materials and/or liquids. Sample 106 may, optionally, be prepared to include a MALDI matrix or be sputter coated with a metal material. Accordingly, the electrosprayed solvent 204 from ESI needle 301 may ionize vaporized molecules from a sample. Sample plate 108 may include, without being limited to, glass, wood, fabric, plastic, brick, paper, metal, a swab, polytetrafluoroethylene (PTFE), or suitable solid phase extraction surfaces.

According to an exemplary embodiment, ESI needle 102 may be biased with a DC voltage, between about 0 to ±6 kV, for example. ESI needle 102 may also be biased by an AC voltage or may be coupled to ground. Sample plate holder 110 may also be biased with a DC voltage $V_1$. For example, the bias $V_1$ applied to sample plate holder 110 may be used to correct for distortion in the electric field which may be between capillary 104 and ESI needle 102, caused by sample holder 110. According to another embodiment, sample plate holder 110 may be biased with an AC voltage. Capillary 104 may also be biased with a DC voltage $V_2$. According to another embodiment, capillary 104 may be biased with an AC voltage or may be coupled to ground. According to an exemplary embodiment, DC voltage $V_1$ is about −2 kV and DC voltage $V_2$ is about −5.3 kV. Sample plate holder 110 may be biased with a DC voltage $V_1$ between about 0 to ±6 kV and capillary 104 may be biased with a DC voltage $V_2$ between about 0 to ±6 kV.

Sample plate holder 110 may include a sample stage (not shown) for adjusting the position of sample 106 in at least one of an x, y or z direction (FIG. 2) to allow for additional sampling or to perform imaging scans.

Figure 3:
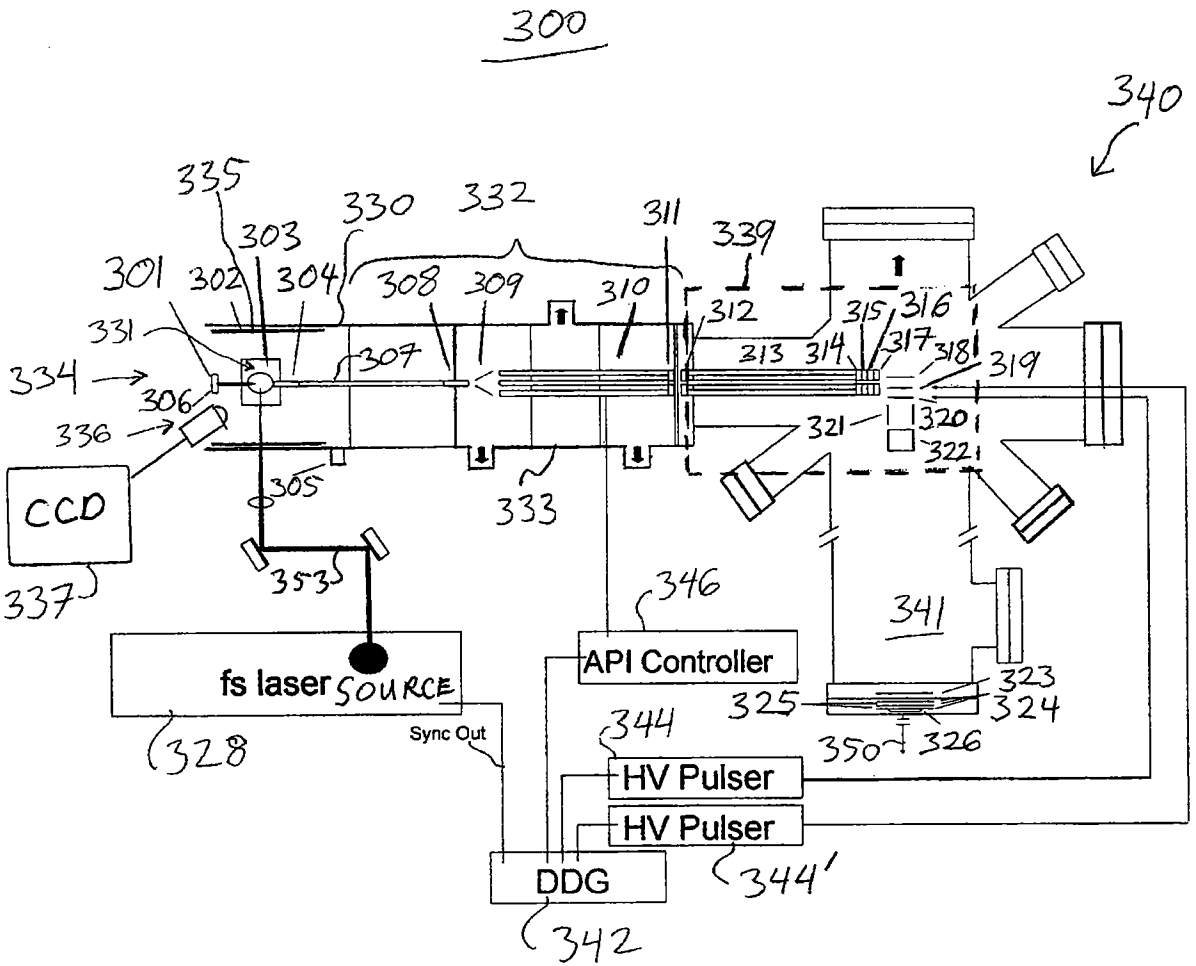
FIG. 3 is a block diagram of an exemplary apparatus for analyzing ions from a sample in accordance with an exemplary aspect of the present invention.

Femtosecond laser beam 112 represents a pulsed fs laser beam from a laser source 328 (FIG. 3). By using an ultrashort pulse duration (i.e., femtosecond laser pulses), the sample may be subjected to reduced thermal damage and less fragmentation. Femtosecond lasers may be coupled into a sample through resonant and/or nonresonant mechanisms. According to an exemplary embodiment, laser beam 112 is a nonresonant femtosecond laser beam. The use of nonresonant femtosecond laser excitation for the vaporization of molecules at atmospheric pressure may reduce sample compatibility restrictions, since the details of the electronic structure of the target molecule are no longer important (due to the nonresonant transitions that occur). Therefore the use of nonresonant femtosecond lasers may allow for a wider variety of molecules to be studied without the need for resonant excitation in the analyte or matrix. According to another embodiment, laser beam 112 may be a resonant femtosecond laser beam.

According to an exemplary embodiment, laser beam 112 may be between about 1 fs to 600 fs, with a centering wavelength between about 200 nm-2000 nm. Laser beam 112 may be manually triggered or include a pulse repetition rate between about 0.1 Hz to 1000 Hz, with a pulse energy between about 10 μJ to 5 mJ.

As shown in FIG. 2, focused femtosceond laser beam 116 is used to vaporize molecules 206 from sample 106. ESI needle 102 includes cavity 202 for directing solvent to the tip of ESI needle 102 where the electrosprayed solvent 204 and vaporized molecules 206 interact to form ions 208. Ions 208 are directed into capillary 104 and analyzed by a mass spectrometer, described further below with respect to FIG. 3.

According to an exemplary embodiment, the vaporization and ionization process may be performed under ambient conditions. The use of nonresonant femtosecond laser beam 112 for vaporization of molecules at ambient conditions may reduce sample restrictions imposed by conventional ionization techniques, allowing a wider variety of molecules to be studied without the need for transferring the sample or the matrix-assisted sample into a vacuum, homogenization, solubility or resonant transitions in the molecule or a matrix-assisted sample. The capability of vaporizing macromolecules without a matrix, at ambient conditions, may be desirable for analyzing biologically relevant molecules, particularly those with limited solubility in polar solvents.

FIG. 3 depicts an exemplary apparatus 300 for analyzing a sample. Apparatus 300 includes an ion generation portion 331 where vaporization of a sample and ionization of the vaporized sample to form ions may be performed under ambient conditions. Apparatus 300 also includes an analyzer 340 for analyzing and detecting the ions. Ion generation portion 331 is similar to ion generator 100, described above in FIGS. 1 and 2.

Ion generation portion 331 includes an electrospray ionization (ESI) needle 301 of an ESI device (not shown in its entirety), a sample holder 303, and a capillary 307. The ESI device may vaporize the molecules using electrospray ionization, extractive electrospray ionization or nano-electrospray ionization.

An optional housing 335 surrounds needle 301, sample holder 303, and capillary 307. According to an exemplary embodiment, housing 335 is transparent and is formed from glass. The housing 335 may be positioned between electrode 302 and metal housing 330. In use, a sample is placed on sample holder 303 and sample holder 303 is introduced into housing 330 where the sample is vaporized by femtosecond laser pulses 353 from laser source 328, to generate vaporized molecules. Housing 335 may be modified to allow the introduction of femtosecond laser pulses 353 from laser source 328 without substantial modification of the pulse duration or beam profile. In an exemplary embodiment, housing 330 is generally cylindrical in shape and may be open to ambient conditions 336 at end 334. Accordingly, components within housing 330 may be exposed to ambient temperature and pressure conditions, referred to herein collectively as ambient conditions 336. An optional charge coupled device (CCD) 337 may be used to image a region of the ion generation portion 331.

Laser source 328 may be configured to provide femtosecond laser pulses 353 to a sample on sample holder 303 in an ablation spot (e.g. ablation spot 120 shown in FIG. 1). Laser source 328 may be configured to operate under nonresonant conditions. According to another embodiment, laser source 328 may be configured to operate under resonant conditions.

Sample holder 303 is configured to hold a sample (not shown). A sample may receive a pulsed femtosecond laser beam 353 from laser source 328. Laser beam 353 may be directed to the sample using optical components. Suitable optical components will be understood by one of skill in the art from the description herein. Sample holder 303 may include a sample stage (not shown) for adjusting the position of the sample in at least one of the x, y or z direction to allow for additional sampling or to perform imaging scans. For example, a sample may be positioned over a plurality of different positions. Analyzer 340 may be used to determine a mass spectrum over the plural positions and generate a spatially resolved m/z image of the analyzed sample.

Capillary 307 includes capillary electrodes 304, 308 provided on opposite ends of capillary 307. In exemplary embodiments, a nebulization gas 306 is not used. The positioning of ESI needle 301 may be adjusted to facilitate the formation of a Taylor cone without the use of nebulizing gas 306. In another embodiment, nebulizing gas 306 may be introduced into ion generation portion 331. In the illustrated embodiment, source chamber electrodes 302 are disposed on opposite sides of sample holder 303.

Apparatus 300 further includes ion propagation region 332 which includes a portion of capillary 307, skimmer 309, hexapole ion guide 310, and DC lenses 311, 312. Dry nitrogen may be introduced into metal housing 330 via inlet 305. Ion propagation region 332 may include a housing 333 coupled to housing 330 and analyzer 340. In general, an enclosure comprising housing 330 and housing 333 may enclose the sample area, the ESI device and ion propagation region 332 under ambient conditions 336. Suitable capillaries, skimmers, guides, and lenses will be understood by one of skill in the art from the description herein.

In operation, molecules from the sample may be vaporized at atmospheric conditions and may be captured by a charged electrosprayed solvent in ion generation portion 331. The solvent may be evaporated away using a dry nitrogen gas introduced at inlet 305 through metal housing 330. The captured ions may be propagated through ion propagation region 332 and analyzed using analyzer 340.

Analyzer 340 includes ion transfer region 339, which may be configured to receive, analyze and detect the sample ions from hexapole 310. Analyzer 340 may detect positively formed ions or negatively formed ions.

In the illustrated embodiment, ion transfer region 339 includes the following components: hexapole ion guide 313; DC lenses 314, 315; X steering plates 316, 321; ground plates 317, 320; extraction plate 318; acceleration plate 319; Y steering plate 322. Analyzer 340 also includes time of flight (TOF) tube 341; entrance screen grid 323; a detector, composed of microchannel plates (MCPs) 325 in a chevron configuration; MCP bias plates 324; and anode 326. Analyzer 340 may be configured to include as at least one of the following detectors MCPs in a Z gap detector, MCPs in a chevron configuration, an electron multiplier, a Faraday cup, an array detector or a photomultiplier conversion dynode. Suitable analyzer components will be understood by one of skill in the art from the description herein. An output signal 350 may be provided to a display (not shown) (e.g., an oscilloscope), a memory (not shown) and/or a remote device (such as a computer).

According to an exemplary embodiment, analyzer 340 may be a mass spectrometer. Analyzer 340 may also include one or more mass spectrometers. For example, two mass spectrometers may be used for tandem mass spectrometry ($MS^n$) capabilities. The mass spectrometer may include a time of flight (TOF) mass spectrometer, such as a pulsed orthogonal TOF mass spectrometer, an orbitrap mass spectrometer, a linear ion trap mass spectrometer, a quadrupole mass spectrometer, a quadrupole ion trap mass spectrometer, a magnetic sector mass spectrometer or a Fourier transform ion cyclotron resonance (FTICR) mass spectrometer.

Analyzer 340 may be configured in such a way as to fragment ions 208 and analyze the produced fragments. This may allow for the identification of structure and may enhance the certainty in the chemical identification of ions 208. Analyzer 340 may be configured to include, without being limited to, at least one of an electron beam, a laser beam, collision-induced dissociation (CID), electron capture dissociation (ECD), electron transfer dissociation (ETD), infrared multiphoton dissociation (IRMPD) or blackbody infrared radiative dissociation (BIRD), to fragment ions 208 in order to identify the structure and enhance the certainty in the chemical identification.

In the illustrated embodiment, apparatus 300 further includes high voltage (HV) pulser 344 and HV pulser 344' coupled to extraction plates 318 and 319. Illustrated apparatus 300 also includes digital delay pulse generator (DDG) 342 and atmospheric pressure ionization (API) controller 346. DDG 342 is coupled to HV pulsers 344, 344' and laser source 328. DDG 342 is coupled to API controller 346 and may be configured to control hexapole ion guide 310 and DC lens 311. API controller 346 may also control the introduction of dry nitrogen to inlet 305 and the introduction of nebulizing gas 306 such as nitrogen, source chamber electrode 302, capillary electrode 304, capillary electrode 308, and skimmer 309. A computer (not shown) may control a sample stage (not shown) coupled to sample holder 303 for adjusting the position of the sample in at least one of the x, y or z direction to allow for additional sampling or to perform imaging scans.

Previously, when femtosecond lasers have been used to perform vaporization, the sample surface is positioned perpendicular to an ion optical axis (where the ESI needle 301 propagates ions along the ion optical axis). In these conventional applications, the sample holder is positioned within the TOF mass spectrometer and the extraction and acceleration plates in the TOF mass spectrometer are biased to a high DC voltage, regardless of whether molecules or ions are observed. According to embodiments of the present invention, sample holder 303 is placed outside of the TOF mass spectrometer. The vaporization, thus, occurs outside of the time of flight analyzer and the molecules are entrained, ionized and transferred from atmospheric pressure using an electrospray source to the high vacuum of the TOF mass spectrometer. The ionized molecules may then be analyzed in the TOF mass spectrometer by pulsing the extraction and acceleration plates of analyzer 340 on and off. Pulsing of these plates may also be used to observe ion peaks without the use of an ion trap.

Because apparatus 300 uses an electrospray process to ionize the vaporized molecules, rather than a further electron or laser beam as used in conventional devices, no additional fragmentation is produced in the vaporized molecules. Accordingly, aspects of the present invention include vaporizing molecules using a femtosecond laser beam and post-ionizing the vaporized molecules using an electrospray process.

Figure 4:
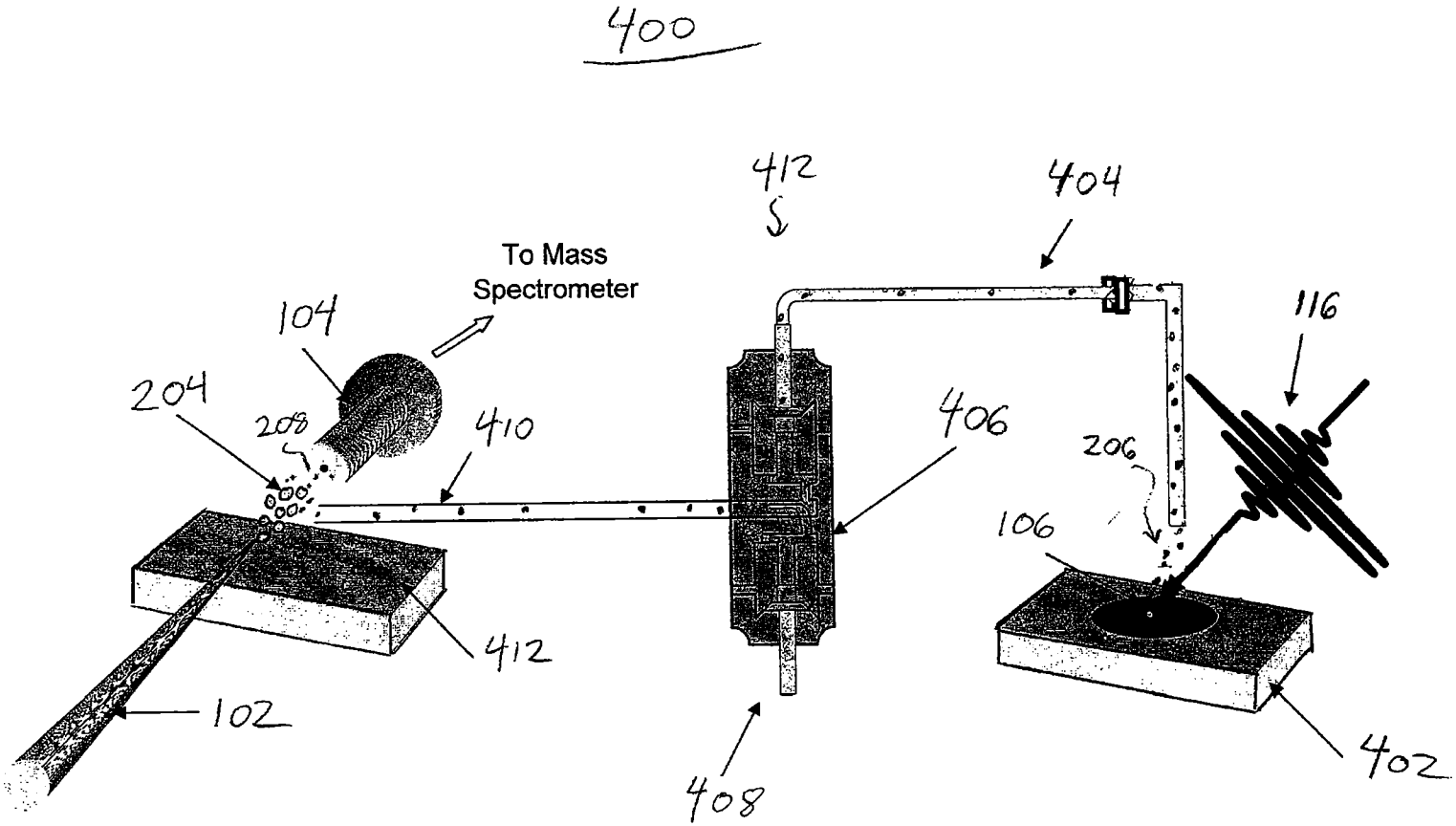
FIG. 4 is a block diagram of an exemplary apparatus for remotely vaporizing a sample to be ionized in accordance with another exemplary aspect of the present invention.

Referring next to FIG. 4, a block diagram of ion generator 400 for remotely vaporizing molecules which are subsequently ionized is shown. Ion generator 400 includes sample plate holder 402, tubing 404, pump 406, outlet feed 410, biased metal plate 412, ESI needle 102 and capillary 104. Suitable components for ion generator 400 will be understood by one of skill in the art from the description herein.

In operation, sample 106 is disposed on sample plate holder 402 which is positioned remote from ESI needle 102. The focused femtosecond laser beam 116 is used to vaporize molecules from sample 106, illustrated as vaporized molecules 206. As described above laser beam 116 may include a nonresonant laser beam or a resonant laser beam. Sample plate holder 402 may include a sample stage (not shown) for adjusting the position of sample 106 in at least one of the x, y or z direction to allow for additional sampling or to perform imaging scans. A transfer system, designated generally as 412, comprising tubing 404, pump 406, gas inlet 408 and outlet feed 410 is used to transfer vaporized molecules 206 to a region between ESI needle 102 and capillary 104.

In an exemplary embodiment, pump 406 includes a Venturi air jet pump with inlet 408 for receiving nitrogen ($N_2$) at a pressure of between about 0-120 psi. Although, in an example embodiment, nitrogen is described as being introduced to inlet 408, the gas may also include, without being limited to, other inert gases such as helium, argon or xenon. As known to a person of skill in the art, Venturi air jet pumps include a constriction in a section of tubing. According to the Bernoulli's principle, a change in fluid pressure due to the constriction creates a vacuum. In an exemplary embodiment, a vacuum of about 14 mmHg is formed by pump 406. The vacuum is used to assist transfer of vaporized molecules 206 from sample 106 to the region between ESI needle 102 and capillary 104, via tubing 404 and outlet feed 410.

Vaporized molecules 206 are directed out of outlet feed 410, above metal plate 412, in the vicinity of a tip of ESI needle 102. Vaporized molecules 206 then interact with electrosprayed solvent 204 to form ions 208. Ions 208 are directed into capillary 104 and analyzed by a mass spectrometer, as described above. Metal plate 412 may be biased with a DC voltage between about 0 to ±6 kV. According to another embodiment, metal plate 412 may be biased with an AC voltage.

Figure 5:
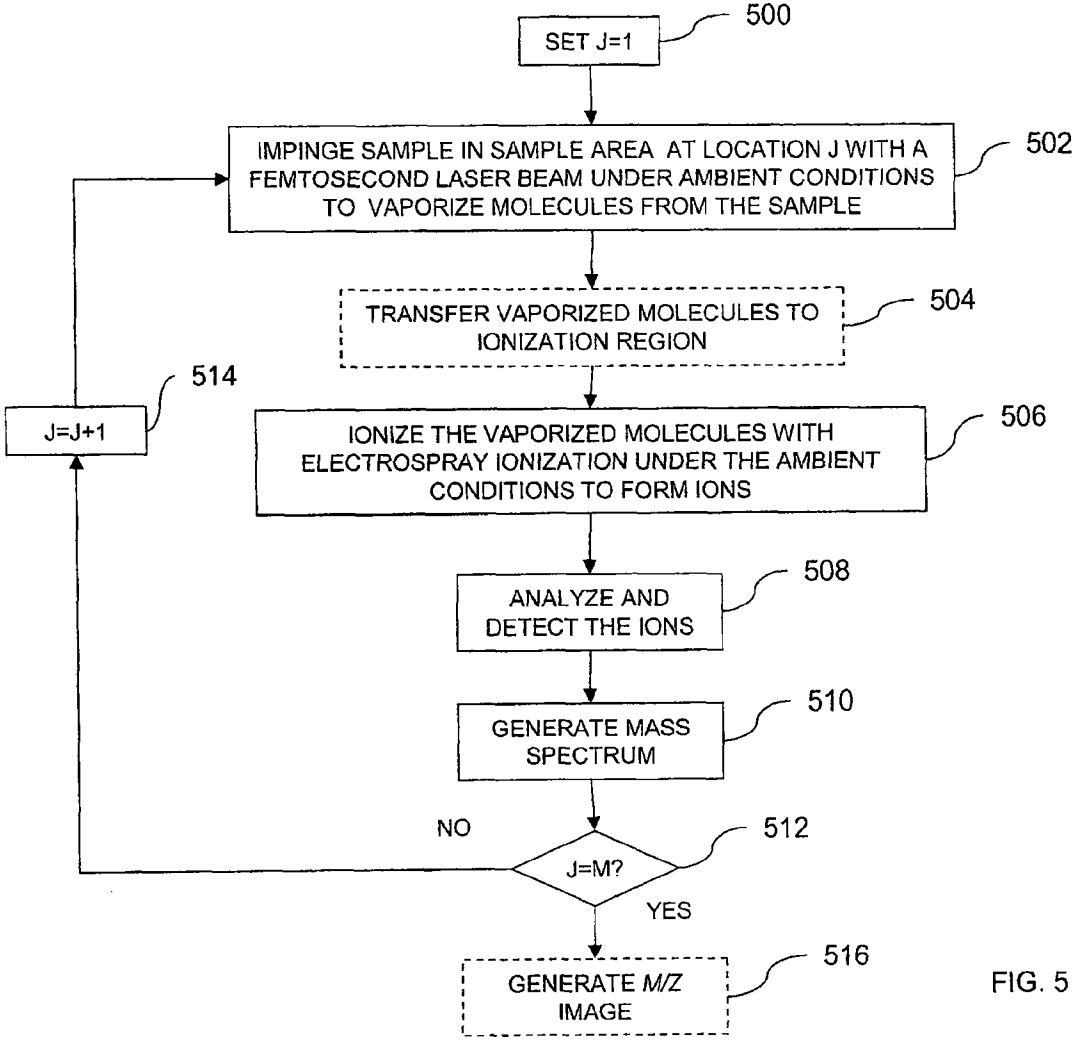
FIG. 5 is a flow chart of exemplary steps for analyzing ions in accordance with an exemplary aspect of the present invention.

FIG. 5 depicts an exemplary method for analyzing a sample. At step 500, a location index (e.g.,J) is initialized (e.g., to 1), for example, by a computer. At step 502, a sample is vaporized in a sample area (e.g., at location 3) with a laser, such as a femtosecond laser beam under ambient conditions. For example, a femtosecond laser beam from laser source 328 (FIG. 3) may be directed to vaporize a sample on sample holder 303. At optional step 504, vaporized molecules may be transferred to an ionization region that is remote from the sample. For example, transfer system 412 (FIG. 4) may direct vaporized molecules 402 to an ionization region in the vicinity of ESI needle 102.

At step 506, the vaporized molecules are ionized, e.g., with electrospray ionization under the ambient conditions, to form ions. For example, ESI needle 301 (FIG. 3) may provide electrospray ionization of the vaporized molecules from a sample on sample holder 303. At step 508, the ions are analyzed and detected, for example, by analyzer 340 (FIG. 3). At step 510, a mass spectrum of the analyzed ions may be formed, for example, by analyzer 340 (FIG. 3).

At step 512, it is determined whether the analysis scan is compete (e.g., index J is equal to M, where M represents a maximum number of locations), for example, by a computer. If the analysis scan is complete (e.g., J is equal to M), step 512 proceeds to optional step 516. At optional step 516, an m/z image is generated for locations 1 through M, for example, by a computer connected to analyzer 340 (FIG. 3).

At step 512, if it is determined that the analysis is not complete (e.g., 3 is not equal to M), step 512 proceeds to step 514. At step 514, the scan is advanced (e.g., index J is incremented). Step 514 proceeds to step 502, and steps 502-510 are repeated until the scan is complete (e.g., J is equal to M).

The present invention is now illustrated by reference to a number of examples. The examples are included to more clearly demonstrate the overall nature of the invention. These examples are exemplary, and not restrictive of the invention.

Examples of In Situ Ion Generation

Referring next to FIGS. 6A-8B, representative mass spectra from samples using in situ ion generation and analysis, for example, using apparatus 300 (FIG. 3) are described. The examples illustrate that intact, nonvolatile macromolecules may be transferred directly from the solid state into the gas phase, in ambient air, for subsequent mass spectral analysis using nonresonant femtosecond laser vaporization combined with electrospray ionization. Mass spectral measurements for neat (i.e., matrix-free) samples and matrix-assisted samples, including pseudoproline dipeptide, protoporphyrin IX and vitamin B12 adsorbed on a glass insulating surface were obtained using an 800 nm, 70 fs laser having an intensity of $10^{13}$ W $cm^{-2}$. Pseudoproline dipeptide, protoporphyrin IX and vitamin B12 represent large biological macromolecules. These biomolecules were chosen based on their size, solubility, and their ability to form multiple charged ions.

Figures 6A, 6B:
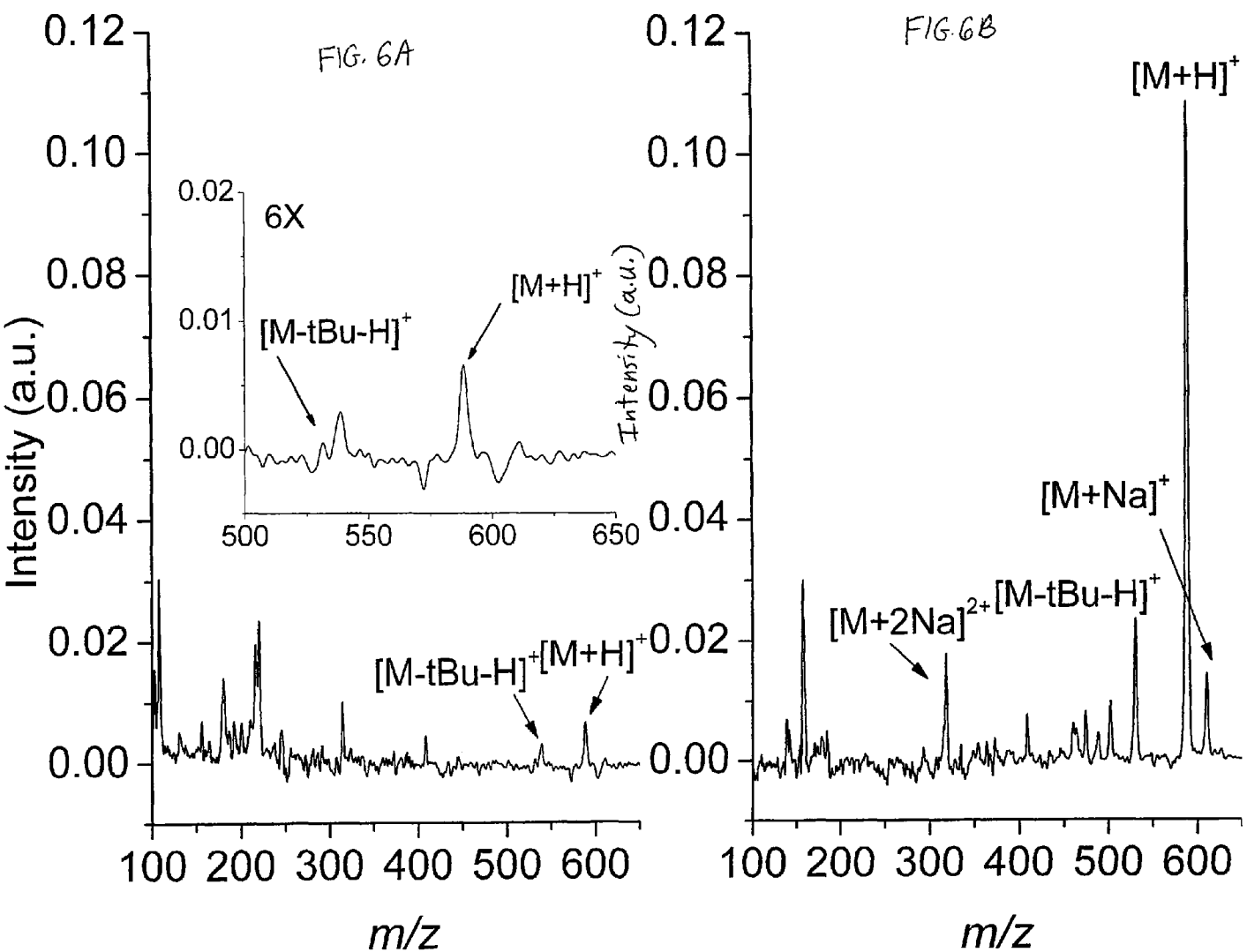
FIGS. 6A and 6B are representative mass spectra of a matrix-free dipeptide sample and a matrix-assisted dipeptide sample vaporized from a dielectric surface, respectively, using an exemplary apparatus for analyzing ions.
Figures 7A, 7B:
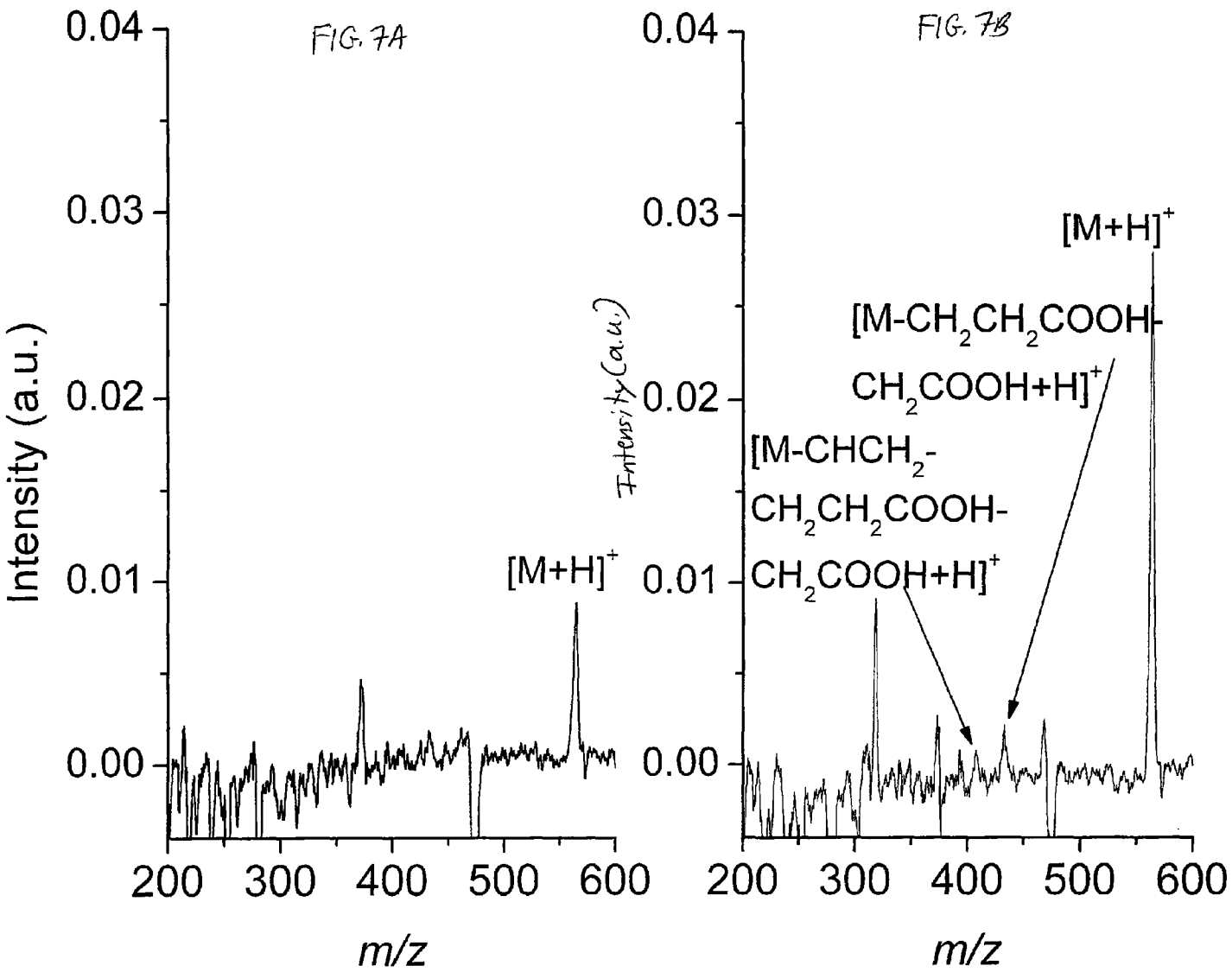
FIGS. 7A and 7B are representative mass spectra of a matrix-free protoporphyrin IX sample and a matrix-assisted protoporphyrin IX sample vaporized from a dielectric surface, respectively, using an exemplary apparatus for analyzing ions.
Figures 8A, 8B:
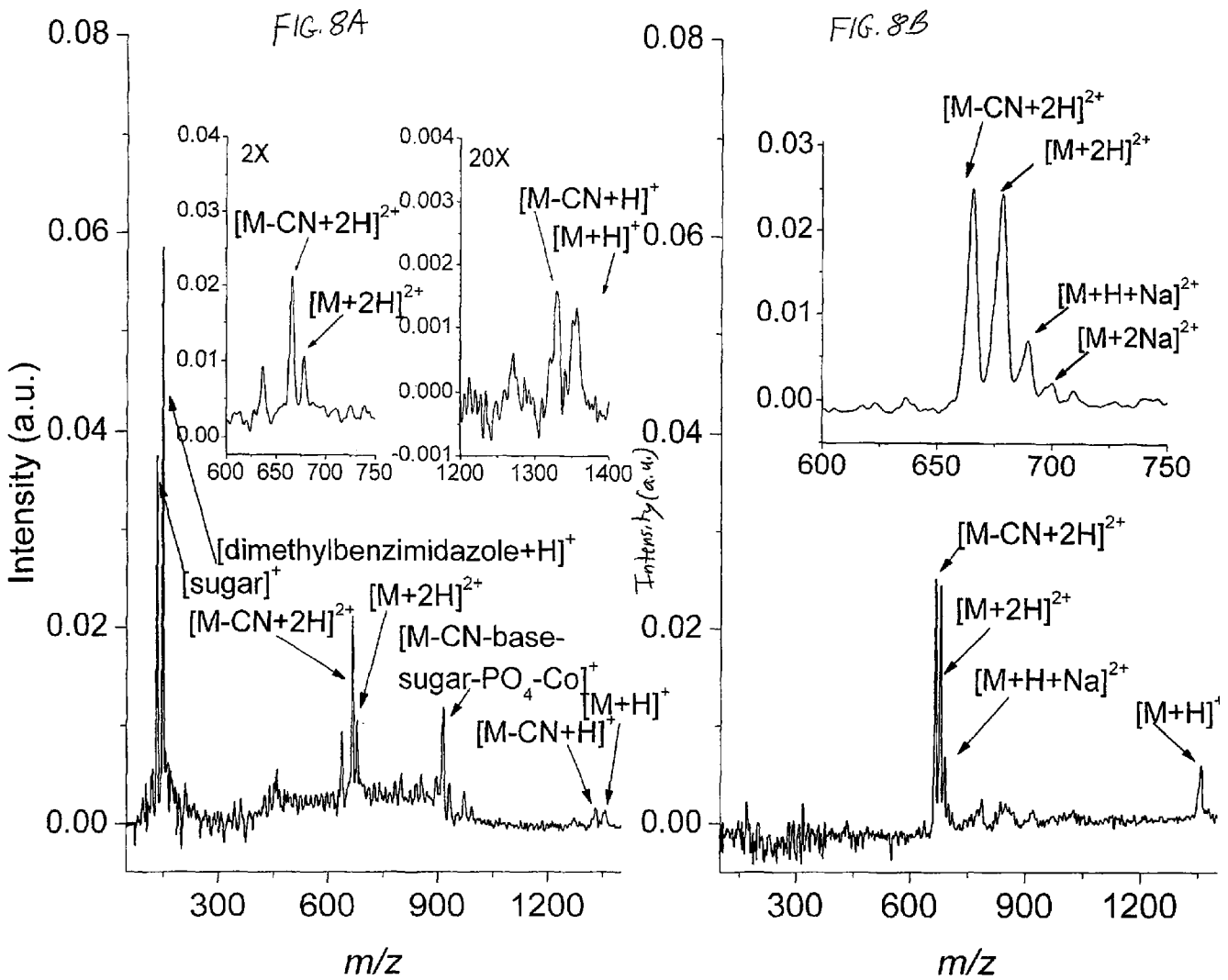
FIGS. 8A and 8B are representative mass spectra of a matrix-free vitamin B12 sample and a matrix-assisted vitamin B12 sample vaporized from a dielectric surface, respectively, using an exemplary apparatus for analyzing ions.

In particular, FIGS. 6A and 6B are mass spectra of a matrix-free dipeptide sample and a matrix-assisted dipeptide sample, respectively; FIGS. 7A and 7B are mass spectra of a matrix-free protoporphyrin IX sample and a matrix-assisted protoporphyrin IX sample, respectively; and FIGS. 8A and 8B are mass spectra of a matrix-free vitamin B12 sample and a matrix-assisted vitamin B12 sample, respectively.

With respect to FIGS. 6A-8B, a titanium(Ti)-sapphire oscillator (e.g., manufactured by KM Labs Inc., Boulder, Colo., USA) was used to seed a regenerative amplifier (e.g., manufactured by Coherent Inc., Santa Clara, Calif., USA) to create 70 fs laser pulses centered at 800 nm with a pulse energy of 2.5 mJ. The laser pulse energy was reduced using a neutral density filter to 1.5 mJ. The laser repetition rate was set to 10 Hz and the synchronous pulse of the laser was used to trigger a digital delay generator (e.g., DDG 342 shown in FIG. 3) used to set the timing of the trap and the extraction plates (e.g., extraction plates 318, 319 shown in FIG. 3) in the mass spectrometer. The laser pulse was directed at the sample (in the form of a dried film) to induce vaporization from the dried film (pseudoproline dipeptide, protoporphyrin IX pr vitamin B12). The laser beam was focused to a spot size of 300 μm in diameter using a 17.5 cm focal length lens, with an incident angle of 45° with respect to the sample. An approximate intensity of the laser beam hitting the sample was about $10^{13}$ W $cm^{-2}$.

Referring to FIG. 1, sample plate holder 110 is biased with $V_1$ equal to −1.5 kV, to correct for the distortion in the electric field caused by sample plate 108. Bias voltage $V_1$ may optimize the entrance current of electrosprayed ions into the dielectric capillary 104. Referring to FIG. 2, the vaporized sample 206 was captured and ionized by electrospraying methanol with 1% acetic acid (for pseudoproline dipeptide and protophyrin IX) or 80:20 methanol:water with 1% acetic acid (for vitamin B12). The solvent was chosen based on the solubility of the sample. The spray direction is perpendicular to the laser vaporized plume trajectory and electrosprayed ions 208 subsequently enter the inlet capillary 104. An ESI solvent background mass spectrum (no laser present) was acquired before each experiment and subtracted from the laser vaporization measurement to produce the spectra shown in FIGS. 6A-8B. Representative mass spectra were obtained and compared for each of the matrix-free and matrix-assisted samples investigated using ion generator 100.

Referring to FIG. 6A, a positive ion mode mass spectrum corresponding to the laser-vaporization of the matrix-free pseudoproline dipeptide sample spotted onto a glass slide is shown. The inset in FIG. 6A shows a 6× magnification of the $[M+H]^+$ and $[M-tBu]^+$ peaks. The mass spectrum illustrates intact protonated parent molecular ions, at m/z ratio of 588, demonstrating the ability to transfer molecules into the gas phase using an intense, nonresonant femtosecond duration pulse at 800 nm. The electrospray solvent produces a series of peaks in the low mass region of the mass spectrum that may be subtracted to reveal the dipeptide features. The solvent intensity can fluctuate and as a result may produce negative or positive features in the mass spectra, when background correction is performed on the laser vaporization mass spectrum. Without the electrosprayed solvent 204 (FIG. 2), no ions were observed in the spectrum (figure not shown), suggesting that ionization occurs when the vaporized molecules are captured by the electrosprayed solvent 204. The amount of sample consumed for this analysis was approximately 1 nmol and can be estimated based on the concentration of the sample, the sample area covered, and the surface area vaporized.

FIG. 6B, shows the mass spectrum of a matrix-assisted dipeptide sample. The matrix-assisted sample corresponding to a 1000:1 molar solution of 2,5-dihydroxybenzoic acid (DHB) and dipeptide spotted on a glass slide. The mass spectrum illustrated in FIG. 6B indicates a strong protonated molecular ion peak. MALDI matrices may be chosen, in part, to enable vaporization of macromolecules. FIG. 6B illustrates an increase of an order of magnitude in signal for the $[M+H]^+$ ion in comparison with the neat sample (FIG. 6A). Matrices are known to promote multiple charged species. The peak observed at m/z 317 corresponds to a doubly charged parent. In FIG. 6B, the increase in signal indicates that the matrix does assist in vaporizing more molecules from the film. Similar to the results for the neat dipeptide sample, no ions were detected without the electrosprayed solvent 204 present (bias voltages on), indicating molecules, not ions, are vaporized in the presence of a MALDI matrix using nonresonant femtosecond lasers.

The pseudoproline dipeptide mass spectra of FIGS. 6A and 6B illustrates fragmentation with and without use of a matrix. The speculated $[M-tBu]^+$ fragment (m/z 529) was observed in both mass spectra (i.e., the neat sample and matrix-assisted sample). The mass spectra in FIGS. 6A and 6B indicate the same ratios of $[M-tBu]^+$ to $[M+H]^+$ when compared to a control experiment for a conventional ESI-MS of pseudoproline dipeptide. Therefore, the $[M-tBu]^+$ fragment ion may be due to collision-induced disassociation (CID), which occurs between capillary 307 (FIG. 3) and skimmer 309 in the ESI ion optics, and may not be a result of the laser interaction with the molecule.

Referring to FIGS. 7A and 7B, matrix-free and matrix assisted samples Protoporphyrin IX were analyzed using an exemplary femtosecond laser vaporization and ionization method according to the present invention. Many biological macromolecules have low solubility in common polar solvents and analysis is difficult using conventional means, such as MALDI and ESI. Protoporphyrin IX is an example of a biologically relevant molecule that has low solubility in common solvents, such as methanol, that are used in electrospray analysis. For the matrix-free sample, $10^{-4}$ M protoporphyrin IX is placed in methanol to form a turbid solution. (The turbid solution indicates the formation of a heterogeneous mixture.) An aliquot of this solution is then spotted onto a glass slide and dried. For the matrix-assisted sample, a 1000:1 molar solution of DHB and protoporphyrin IX was spotted on a glass slide. The thin film of protoporphyrin (both for the matrix-free and matrix-assisted samples) was then analyzed using femtosecond nonresonant laser vaporization with ESI post-ionization. A conventional ESI-MS was also collected using a filtered portion of the protoporphyrin IX solution.

As shown in FIG. 7A, mass spectrum for the matrix-free sample shows a strong protonated molecular ion of m/z 564. As shown in FIG. 7B, when protoporphyrin IX is mixed with the matrix and vaporized using the nonresonant fs laser pulse, little fragmentation occurs and a factor of two fold enhancement is observed in the protonated parent ion. No dimer was present in either the matrix-free or the matrix-assisted spectrum for protoporphyrin IX. In contrast, dimmers were present in the conventional ESI-MS mass spectrum (not shown). The results suggest that the exemplary femtosecond laser vaporization and ionization process may place intact single molecules into the gas phase, while the conventional ESI-MS can place dimers and aggregates. When the electrospray was not present during vaporization of the protoporphyrin IX (both for the matrix-free and matrix-assisted sample (with the bias voltages on), no molecular ions were observed in the spectrum.

In FIGS. 7A and 7B, the protoporphyrin IX mass spectra reveals several fragment ions at m/z 407 and 433. The small fragment peaks shown in the matrix-free spectrum were also present in a conventional ESI-MS of protoporphyrin IX, but in different ratios to the parent molecular ion. The fragments may be caused by interaction with the laser, not due to CID in the electrospray. The ions are speculated to correspond to the $[M\text{-}4CH_3\text{-}2CH_2\text{-}2COOH+Na]^+$ and $[M—CH_3\text{-}2CHCH_2\text{-}2COOH+H]^+$ fragments, respectively. The protoporphyrin IX example demonstrates that molecules that have low solubility in polar solvents can still be detected using nonresonant femtosecond laser vaporization from neat films.

Referring next to FIGS. 8A and 8B, mass spectra for vitamin B12 using an exemplary nonresonant femtosecond laser vaporization and ionization process are shown. Vitamin B12 (mass=1355 Da) was used to investigate the ionization mechanism and determine the ability to vaporize larger macromolecules.

Referring to FIG. 8A, the mass spectrum corresponding to a matrix-free sample of vitamin B12 spotted on a glass slide indicates $[M+H]^+$ and the $[M+2H]^{2+}$ ion peaks. The inset of FIG. 8A represents a 2× magnification of the $[M+2H]^{2+}$ ion peaks (left) and the $[M+H]^+$ ion peak (right).

Referring to FIG. 8B, the mass spectrum corresponding to a matrix-assisted sample (i.e., a 1000:1 molar solution of DHB and vitamin B12 spotted on a glass slide) also indicates the $[M+H]^+$ and the $[M+2H]^{2+}$ ion peaks. The inset of FIG. 8B illustrates a 2× magnification of the $[M+2H]^{2+}$ ion peaks. When vitamin B12 is mixed with the matrix and vaporized using the nonresonant fs laser pulse, little fragmentation occurs and a factor of three enhancement is observed for both the doubly and singly charged protonated parent ions, as shown in FIG. 8B. When the ESI plume was not present during vaporization of vitamin B12 (both with or without a matrix), no molecular ions were observed in the mass spectra.

Vitamin B12 is a complex macromolecule with a propensity to fragment after irradiation with ultraviolet (UV) and infrared (IR) lasers. The low mass region of the matrix-free vitamin B12 mass spectrum reveals ions at: m/z 132 (for the matrix-free sample), 147 (for the matrix-free sample), 666 (both for the matrix-free and matrix-assisted samples), 914 (for the matrix-free sample), and 1331 (for the matrix-free sample). The fragment peaks were not contained in the conventional ESI-MS of vitamin B12. The fragments shown in FIGS. 8A and 8B may be caused by interaction of the sample with the laser. The ions are speculated to be attributed to the pentose fragment, the dimethylbenzimidazole (base) fragment, $[M—CN+2H]^{2+}$, and $[M—Co—CN\text{-base-sugar-}PO_4]^+$, respectively.

Previous investigations have demonstrated that multiple charging is prevalent in the conventional ESI-MS of vitamin B12. A conventional ESI-MS of vitamin B12 was performed and indicated the $[M+H]^+$ and the $[M+2H]^{2+}$ ions (figure not shown) are similar to those detected by the exemplary femtosecond laser vaporization and ionization mass spectrum shown in FIG. 8A. These results suggest that molecules, not ions, are vaporized and subsequently ionized in the ESI transfer to the capillary inlet orifice. It is contemplated that other biologically relevant macromolecules with higher charge states may also be analyzed using the exemplary femtosecond laser vaporization and ionization methods of the present invention.

Figure 9:
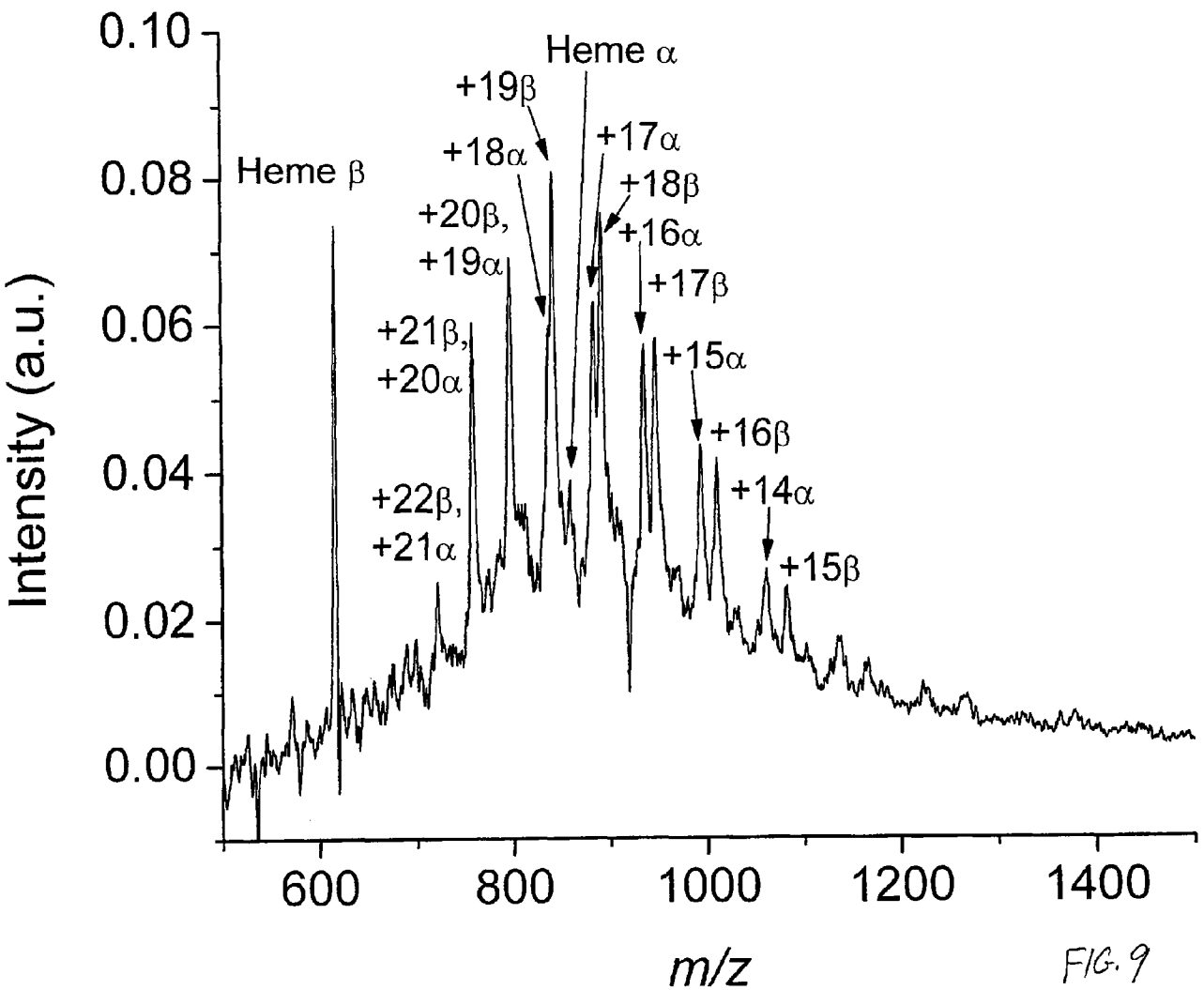
FIG. 9 is a representative mass spectrum of human blood vaporized from a metal surface, using an exemplary apparatus for analyzing ions.

Human blood contains red and white blood cells, platelets and plasma. Red blood cells contain hemoglobin, an oligomeric protein which transports oxygen from the lungs to cells. Hemoglobin makes up about 97% of the dry content and 35% of the total content (including water) of the red blood cells. Referring next to FIG. 9, a representative mass spectrum of undiluted whole human blood is shown, using an exemplary nonresonant femtosecond laser vaporization and ionization method of the present invention. A 20 μL aliquot of whole blood was taken from a healthy volunteer and deposited onto a stainless steel slide 108 (FIG. 1) and placed onto the sample holder 110 without any matrix added to the aliquot of blood. The wet human blood was vaporized using the focused nonresonant laser 116 (FIG. 1). The setup was similar to the setup described above for FIGS. 6-8, except that the laser pulse energy was about 1 mJ. The laser repetition rate was set to 10 Hz and the laser beam was focused to a spot size of about 200 μm in diameter using a 17.5 cm focal length lens, with an incident angle of 45° with respect to the sample. An approximate intensity of the laser beam hitting the sample was about $10^{13}$ W $cm^{-2}$. The electrosprayed solvent used in this experiment consisted of 1:1 water:methanol with 1% acetic acid.

The mass spectrum shown in FIG. 9 displays the α chains (mass>15,000 Da), β chains (mass>15,000 Da) of hemoglobin and the α and β heme groups from hemoglobin. The analysis of hemoglobin from human blood demonstrates the capability to vaporize, ionize and detect large biomolecules under atmospheric conditions with substantially no sample preparation, addition of matrix or a resonant transition.

Figure 10:
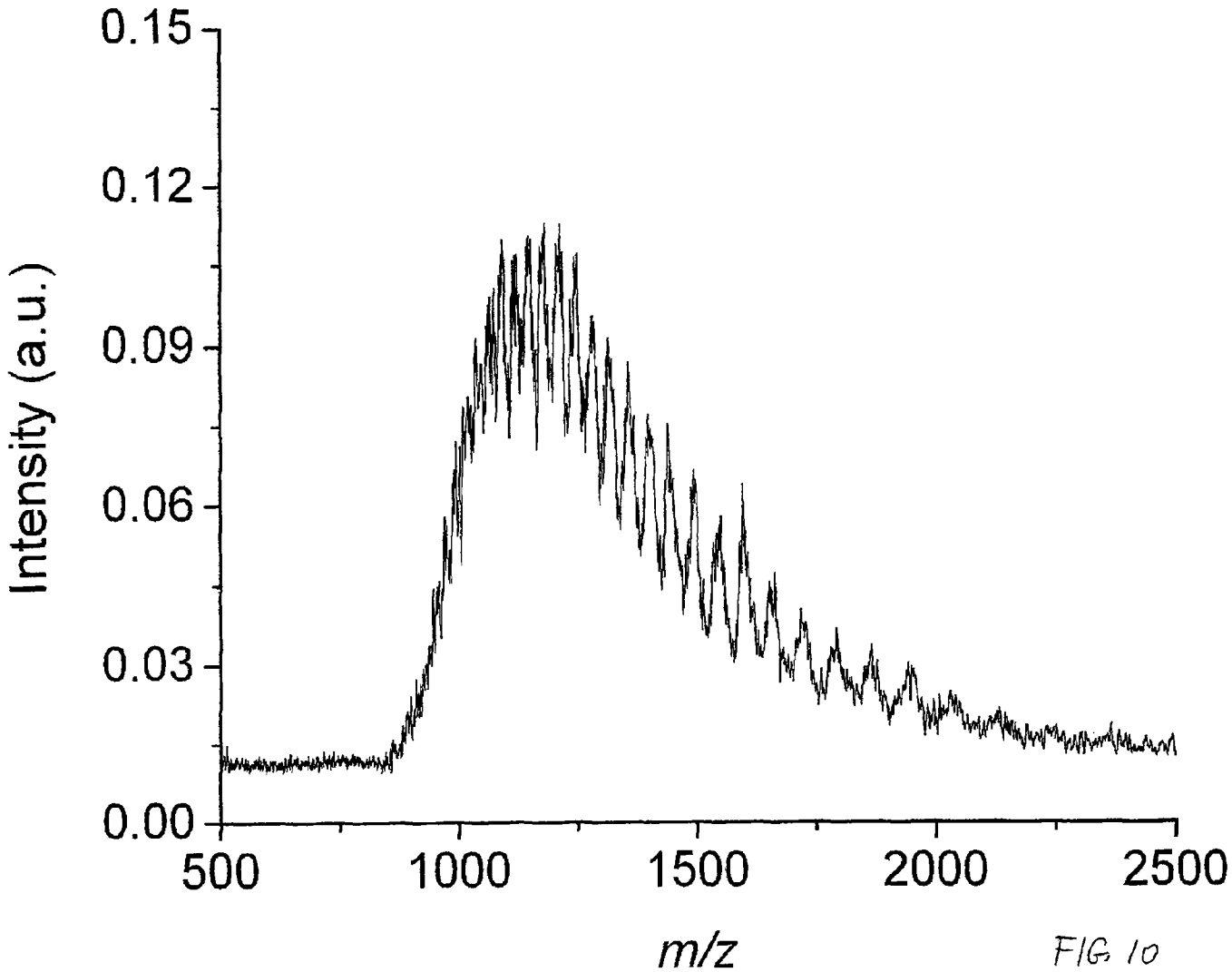
FIG. 10 is a representative mass spectrum of ovalbumin vaporized from a metal surface, using an exemplary apparatus for analyzing ions.

Ovalbumin (mass>43,000 Da) is the main protein found in hen egg whites, composing about 60-65% of the total protein content of the egg. Referring next to FIG. 10, a representative mass spectrum of ovalbumin, another large biomolecule, is shown. A 20 μL aliquot of $10^{-3}$ M ovalbumin dissolved in deionized water was deposited onto a stainless steel slide 108 (FIG. 1) and placed onto the sample holder 110. No matrix was added to the prepared solution of ovalbumin. The wet droplet of ovalbumin in water was vaporized using the focused nonresonant laser 116 (FIG. 1). In FIG. 10, an exemplary nonresonant femtosecond laser vaporization and ionization method according to the present invention is used on a sample of ovalbumin. The setup was similar to the setup described above for FIGS. 6-8, except that the laser pulse energy was approximately 1 mJ. The laser repetition rate was set to 10 Hz and the laser beam was focused to a spot size of about 200 μm in diameter using a 17.5 cm focal length lens, with an incident angle of 45° with respect to the sample. An approximate intensity of the laser beam hitting the sample was about $10^{13}$ W $cm^{-2}$. The electrosprayed solvent used in this experiment consisted of 1:1 water:methanol with 1% acetic acid.

The analysis of ovalbumin demonstrates the capability to vaporize, ionize and detect large biomolecules, for example, greater than or equal to 43,000 Da, under ambient conditions, without matrix or a resonant transition.

Examples of Remote Vaporization

Figure 11A:
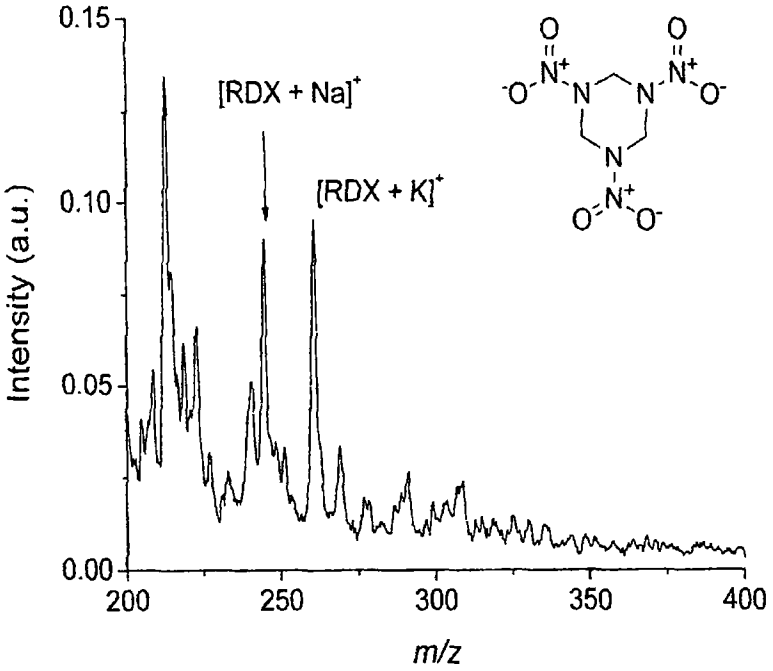
FIGS. 11A, 11B and 11C are representative mass spectra of RDX and RDX-based propellants using an exemplary apparatus for remotely vaporizing a sample at various distances to be ionized and analyzed.
Figure 11B:
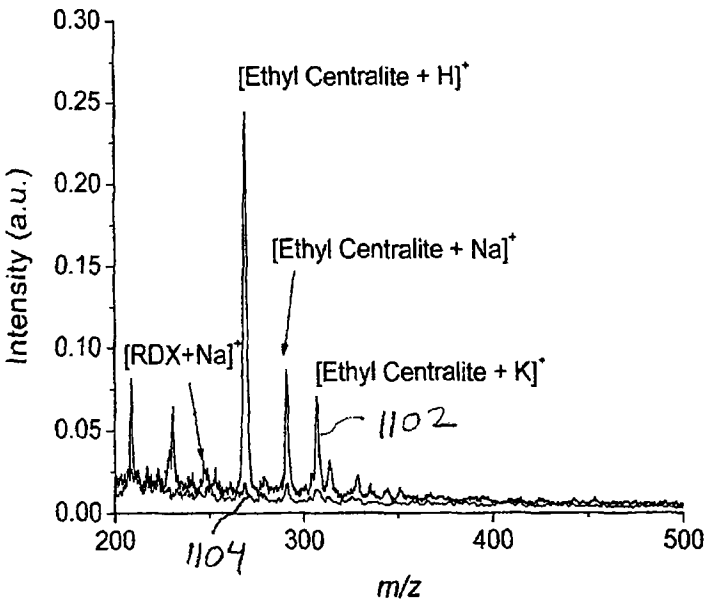
Figure 11C:
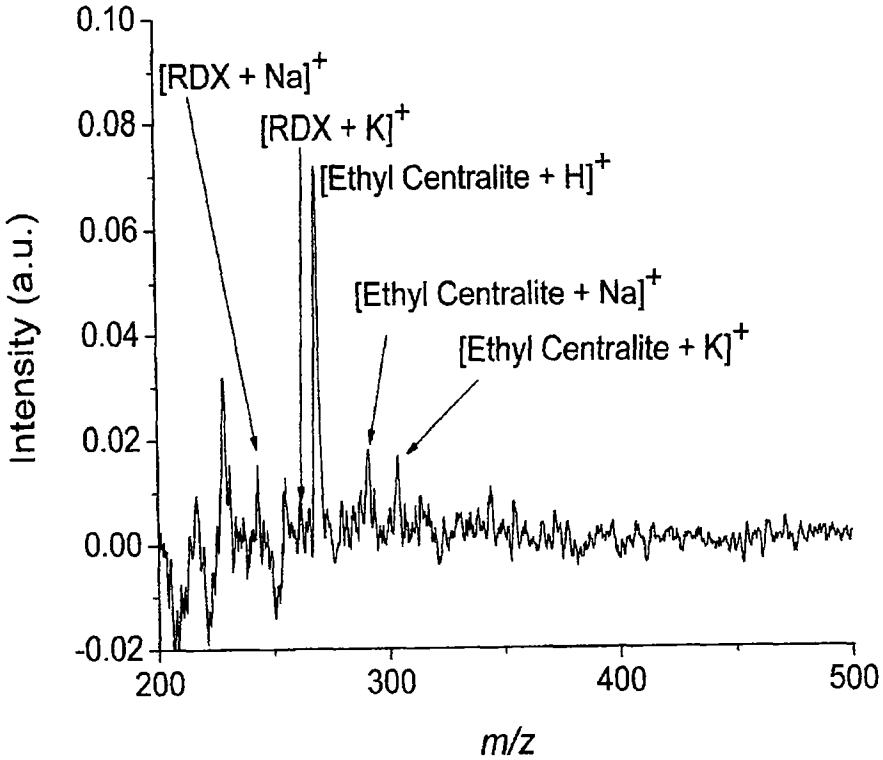

Referring next to FIGS. 11A, 11B and 11C, remote nonresonant vaporization of samples, for example, using the exemplary remote ion generator 400 (FIG. 4) is described. In particular, samples of 1,3,5-trinitroperhydro-1,3,5-triazine (RDX) and RDX-based propellants are vaporized with a nonresonant femtosecond laser from distances of 2 m and 6 m from ESI needle 102 (FIG. 4). Samples (5.55 μg/$cm^2$, 25 nmol/$cm^2$) of RDX and an RDX propellant were prepared (resulting in a 1.85 μg, 8.33 nmol deposition) on a stainless steel slide placed on a sample plate holder (e.g., sample plate holder 402 of FIG. 4). A nonresonant femtosecond laser was used to vaporize molecules from the RDX and RDX propellant without the addition of a matrix. The vaporized molecules were transferred to an ESI needle (e.g., ESI needle 102 of FIG. 4) via a transfer system (e.g., transfer system 412 of FIG. 4). The vaporized molecules are ionized by electrosprayed solvent 204 (FIG. 4) from the ESI needle (e.g., ESI needle 102 of FIG. 4) and are transferred into the capillary (e.g., capillary 104 of FIG. 4). The laser pulse energy was approximately 1 mJ. The laser repetition rate was set to 10 Hz and the laser beam was focused to a spot size of about 200 μm in diameter using a 17.5 cm focal length lens, with an incident angle of 45° with respect to the sample. The intensity of the laser beam hitting the sample was approximately $10^{13}$ W $cm^{-2}$. Metal plate 412 (FIG. 4) was biased to −2 kV to correct for distortion in the electric field between the ESI needle 102 and the capillary 104. A metal plate used to hold plate 402 was not biased in these experiments. The electrosprayed solvent used in this experiment consisted of 1:1 water:methanol with 0.5% of a 1 mM solution of sodium chloride and potassium chloride.

FIG. 11A shows the mass spectrum of RDX vaporized at a distance of 2 m from the ESI needle. FIG. 11B shows the mass spectrum of an RDX formulation containing RDX and propellants (element 1102) and an ESI solvent blank (no laser vaporization, element 1104), vaporized at a distance of 2 m from the ESI needle. FIG. 11C shows the mass spectrum of the RDX formulation, vaporized at a distance of 6 m from the ESI needle. The mass spectra shown in FIGS. 11A-11C demonstrate the capability to remotely vaporize molecules such as explosives, and to ionize and detect the molecules under ambient conditions.

As illustrated in the above examples, exemplary vaporization and ionization methods and apparatus of the present invention may use nonresonant excitation of samples. The samples may be a solid material and/or a liquid material, and do not require being placed in an aqueous medium (such as a matrix) for the analysis. According to an exemplary embodiment, the vaporization and ionization may be performed under ambient conditions. In addition, the vaporization may be performed remote from the ionization. The femtosecond laser provides vaporization, which does not substantially destroy or fragment the sample. Because of the ultrashort pulse duration of the femtosecond laser, there is a reduced crater depth and width from laser ablation, causing less damage to the sample, which may increase the resolution of the mass spectrum and/or m/z image.

Methods and apparatus of the present invention may be used for medical applications, such as cancer diagnostics, biopsy sample analysis, membrane bound protein analysis, and for spatially resolved molecular imaging and depth profiling. For example, with respect to cancer diagnostics, sample analysis may determine the molecular weight of proteins specific to different stages of cancer and develop assays based on the molecular weight of the proteins. For biopsy sample analysis, the analysis may determine different proteins in the sample by focusing a femtosecond laser on a hair-sized cross section and a library of proteins may be obtained for reference purposes. For membrane bound protein analysis, membrane bound proteins in humans and/or animals may be characterized, such as to differentiate normal proteins from cancer proteins and to assess the efficacy of drug delivery in patients administered with different drug carriers. Molecular imaging and depth profiling may be used to examine the biochemistry of tissues in plants and anima Is.

Methods and apparatus of the present invention may be used for non-medical applications, such as to characterize nanocomposites, nanoparticles and for the synthesis of nanomaterials. Nanocomposites may be characterized in terms of morphology, dispersion and molecular weight. Nanoparticles may be characterized to determine the dispersion of size in a batch of synthesized nanoparticles. A dispersion of nanoparticles embedded across a polymer matrix may also be determined. A shaped femtosecond laser pulse may be used to guide the formation of uniformly sized nanoparticles, to perform the custom synthesis of nanomaterials.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An apparatus for analyzing samples, comprising:

a laser configured to non-resonantly vaporize molecules, without ionization from a sample in a sample area with a femtosecond laser beam under ambient conditions;

an electrospray ionization (ESI) device positioned proximate to the sample area, the ESI device configured to ionize the vaporized molecules under the ambient conditions to form ions; and an analyzer configured to analyze and detect the ions.

2. The apparatus according to claim 1, wherein the analyzer includes at least one mass analyzer.

3. The apparatus according to claim 1, wherein the analyzer is configured to fragment the ions and analyze the fragments.

4. The apparatus according to claim 1, wherein the analyzer detects at least one of positively formed ions or negatively formed ions.

5. The apparatus according to claim 1, the apparatus further comprising a capillary configured to receive the ions from the ESI device and to direct the ions to the analyzer.

6. The apparatus according to claim 5, wherein the capillary is biased by a voltage.

7. The apparatus according to claim 1, wherein the ions provide an indication of at least one of a biological macromolecule, a protein, a peptide, a lipid, a carbohydrate, a nucleic acid, a chemical warfare agent, DNA, RNA, a pathogen, a serum, a polymer, a man made synthesized compound, an extracted natural compound, a food sample, a pharmaceutical, a narcotic, an explosive, a dye, a cell, a virus, human tissue, animal tissue, plant tissue, a cell, a biological fluid, blood, a biopsy sample, a nanomaterial or a nanoparticle in the sample.

8. The apparatus according to claim 1, wherein the sample includes at least one of a matrix-free sample or a matrix-assisted sample.

9. The apparatus according to claim 1, wherein the ESI device is biased by a voltage.

10. The apparatus according to claim 1, further comprising a sample holder configured to hold the sample.

11. The apparatus according to claim 10, wherein the sample holder is biased by a voltage.

12. The apparatus according to claim 10, wherein the sample holder is configured to be positioned over a plurality of positions, wherein the analyzer is configured to analyze and detect the ions over the plurality of positions.

13. The apparatus according to claim 12, wherein the analyzer is configured to determine a mass spectrum from the analyzed ions over the plurality of positions and generate a spatially resolved m/z image of the analyzed sample.

14. An apparatus for remotely analyzing samples, comprising:

a laser configured to non-resonantly vaporize molecules, without ionization from a sample in a sample area with a femtosecond laser beam under ambient conditions;

an electrospray ionization (ESI) device positioned remote from the sample area, the ESI device configured to ionize the vaporized molecules under the ambient conditions to form ions;

a transfer system configured to transfer the vaporized molecules from the sample to a region proximate the ESI device; and an analyzer configured to analyze and detect the ions.

15. The apparatus according to claim 14, wherein the transfer system comprises:

a tube disposed above the sample, having a first end configured to receive the vaporized molecules and a second end configured to provide the vaporized molecules to the region proximate to the ESI device; and a pump including a vacuum configured to assist transfer of the vaporized molecules from the sample to the ESI device.

16. The apparatus according to claim 14, further comprising a metal plate positioned in a vicinity of the region proximate to the ESI device, the metal plate biased by a voltage.

17. The apparatus according to claim 14, further comprising a sample holder configured to hold the sample, wherein the sample holder is configured to be positioned over a plurality of positions, wherein the analyzer is configured to analyze and detect the ions over the plurality of positions.

18. The apparatus according to claim 17, wherein the analyzer is configured to determine a mass spectrum from the analyzed ions over the plurality of positions and generate a spatially resolved m/z image of the analyzed sample.

19. A method for analyzing samples, comprising:

non-resonantly vaporizing molecules, without ionization from a sample in a sample area with a femtosecond laser beam under ambient conditions;

ionizing the vaporized molecules with electrospray ionization under the ambient conditions to form ions; and analyzing and detecting, the ions.

20. The method according to claim 19, wherein the vaporized molecules are ionized without substantially fragmenting the vaporized molecules.

21. The method according to claim 19, wherein the vaporized molecules are ionized with substantial fragmentation of the vaporized molecules.

22. The method according to claim 19, wherein the vaporized molecules are ionized in an ionization region remote from the sample area and the method includes:

transferring the vaporized molecules from the sample area to the ionization region.

* * * * *